US010626576B2

(12) United States Patent
Smekal

(10) Patent No.: US 10,626,576 B2
(45) Date of Patent: Apr. 21, 2020

(54) LOADER WITH TELESCOPIC LIFT ARM

(71) Applicant: Clark Equipment Company, West Fargo, ND (US)

(72) Inventor: Jan Smekal, Lhota u Dolnich Břežan (CZ)

(73) Assignee: Clark Equipment Company, West Fargo, ND (US)

( * ) Notice: Subject to any disclaimer, the term of this patent is extended or adjusted under 35 U.S.C. 154(b) by 0 days.

(21) Appl. No.: 15/842,378

(22) Filed: Dec. 14, 2017

(65) Prior Publication Data

US 2018/0171578 A1 Jun. 21, 2018

Related U.S. Application Data

(60) Provisional application No. 62/571,491, filed on Oct. 12, 2017, provisional application No. 62/435,224, filed on Dec. 16, 2016.

(51) Int. Cl.
*E02F 3/43* (2006.01)
*B66F 9/08* (2006.01)
(Continued)

(52) U.S. Cl.
CPC ..... *E02F 3/431* (2013.01); *B66F 9/08* (2013.01); *B66F 9/24* (2013.01); *E02F 3/286* (2013.01);
(Continued)

(58) Field of Classification Search
CPC ..... E02F 3/286; B66F 9/0759
See application file for complete search history.

(56) References Cited

U.S. PATENT DOCUMENTS 2,538,000 A 1/1951 Hoar et al.
2,877,915 A 3/1959 Puim
(Continued)

FOREIGN PATENT DOCUMENTS

CN 104975624 A 10/2015
DE 1949385 A1 4/1970
(Continued)

OTHER PUBLICATIONS

International Search Report and Written Opinion dated Jul. 25, 2018 from the European Patent Office for International Application No. PCT/US2017/066432 filed Dec. 14, 2017, 23 pages.
(Continued)

*Primary Examiner* — Ronald P Jarrett
(74) *Attorney, Agent, or Firm* — John D. Veldhuis-Kroeze; Westman, Champlin & Koehler, P.A.

(57) ABSTRACT

Disclosed power machines include a lift arm structure having a first arm pivotally mounted to a frame and a second arm, coupled to an implement interface, configured to telescopically extend from and retract into the first arm. A control system controls a first actuator to raise and lower the first arm, and controls a second actuator to extend and retract the second arm relative to the first arm. The control system is configured to control the first and second actuators to implement a lift operation, responsive to an operator input. During the lift operation, the first actuator raises the first arm and the second actuator extends and retracts the second arm to maintain a substantially linear path, such as a vertical path, of the implement interface or an implement attached to the implement interface.

21 Claims, 11 Drawing Sheets

(51) Int. Cl.

| | |
|---|---|
| ***B66F 9/24*** | (2006.01) |
| ***E02F 3/28*** | (2006.01) |
| ***E02F 3/42*** | (2006.01) |
| ***E02F 9/16*** | (2006.01) |
| ***E02F 9/20*** | (2006.01) |
| *B66F 9/075* | (2006.01) |

(52) U.S. Cl.
CPC ..... *E02F 3/422* (2013.01); *E02F 3/433* (2013.01); *E02F 3/434* (2013.01); *E02F 9/16* (2013.01); *E02F 9/2004* (2013.01); *B66F 9/0759* (2013.01)

(56) References Cited

U.S. PATENT DOCUMENTS

| | | | |
|---|---|---|---|
| 2,980,271 | A | 4/1961 | Ulinski |
| 3,178,046 | A | 4/1965 | Lull |
| 3,215,292 | A | 11/1965 | Halls |
| 3,411,647 | A | 11/1968 | Zimmerman |
| 3,526,329 | A | 9/1970 | Anderson et al. |
| 3,586,195 | A | 6/1971 | Beltrami |
| 3,651,971 | A | 3/1972 | McGuinness |
| 3,658,202 | A | 4/1972 | Peterson |
| 3,730,362 | A | 5/1973 | Hurlburt et al. |
| 3,937,339 | A | 2/1976 | Geis et al. |
| 3,967,744 | A | 7/1976 | Goyarts |
| 3,995,761 | A | 12/1976 | Hurlburt |
| 4,082,197 | A | 4/1978 | Stedman |
| 4,147,263 | A | 4/1979 | Frederick et al. |
| 4,162,873 | A | 7/1979 | Smith, Jr. |
| 4,280,783 | A | 7/1981 | Hayward |
| 4,306,832 | A | 12/1981 | Schmiesing |
| 4,355,946 | A | 10/1982 | Wykhuis et al. |
| 4,388,038 | A | 6/1983 | Freitag |
| D276,758 | S | 12/1984 | Krueck et al. |
| 4,699,560 | A | 10/1987 | Ostermeyer et al. |
| 4,722,044 | A | 1/1988 | Heiser et al. |
| 4,791,549 | A | 12/1988 | Heiser et al. |
| 4,910,662 | A | 3/1990 | Heiser et al. |
| 4,964,778 | A | 10/1990 | Muto et al. |
| 4,964,780 | A | 10/1990 | Karvonen |
| 4,986,721 | A | 1/1991 | Lowder et al. |
| 5,106,257 | A | 4/1992 | Braud et al. |
| 5,156,520 | A | 10/1992 | Ericson et al. |
| D362,329 | S | 9/1995 | Heiler |
| 5,511,932 | A | 4/1996 | Todd et al. |
| 5,518,358 | A | 5/1996 | Aschcroft et al. |
| 5,520,500 | A | 5/1996 | McIlwain et al. |
| 5,542,814 | A | 8/1996 | Ashcroft et al. |
| D376,372 | S | 12/1996 | Little et al. |
| 5,609,464 | A | 3/1997 | Moffitt et al. |
| D407,415 | S | 3/1999 | Flatau et al. |
| 5,964,567 | A | 10/1999 | Bamford |
| 6,171,050 | B1 | 1/2001 | Johnson |
| D440,236 | S | 4/2001 | Kraft et al. |
| D452,598 | S | 12/2001 | Sato |
| 6,325,589 | B1 | 12/2001 | Jang et al. |
| 6,474,933 | B1 | 11/2002 | Hoechst et al. |
| D469,448 | S | 1/2003 | Bares et al. |
| 6,557,276 | B2 | 5/2003 | Contoli et al. |
| 6,616,398 | B2 | 9/2003 | Dershem et al. |
| D492,327 | S | 6/2004 | Albright et al. |
| 6,755,604 | B1 | 6/2004 | Schaeff |
| 7,104,181 | B2 | 9/2006 | Bitter et al. |
| D535,805 | S | 1/2007 | Stark |
| 7,384,233 | B2 | 6/2008 | Segerljung |
| D572,276 | S | 7/2008 | Pinther et al. |
| 7,507,064 | B2 | 3/2009 | Shibuya |
| 7,516,614 | B2 | 4/2009 | Bitter |
| D626,972 | S | 11/2010 | Hoover et al. |
| D646,306 | S | 10/2011 | Bradley et al. |
| 8,070,413 | B2 | 12/2011 | Brooks et al. |
| 8,152,433 | B2 | 4/2012 | Yamada et al. |
| D692,031 | S | 10/2013 | Martin et al. |
| D702,263 | S | 4/2014 | Jacobsthal et al. |
| D708,233 | S | 7/2014 | Furuki et al. |
| 8,965,637 | B2 | 2/2015 | Brooks et al. |
| 9,045,320 | B2 | 6/2015 | Turrini |
| 9,045,882 | B2 | 6/2015 | Major et al. |
| 9,073,739 | B2 | 7/2015 | Woods et al. |
| D758,039 | S | 5/2016 | Nessler et al. |
| D762,740 | S | 8/2016 | Okuyama et al. |
| D765,738 | S | 9/2016 | Treinen et al. |
| D771,345 | S | 11/2016 | Wen et al. |
| D772,307 | S | 11/2016 | Datema et al. |
| D773,146 | S | 11/2016 | Sauvaget |
| D773,536 | S | 12/2016 | Fiser et al. |
| D774,105 | S | 12/2016 | Jilbert et al. |
| D774,107 | S | 12/2016 | Fiser et al. |
| D778,522 | S | 2/2017 | Stark |
| D789,427 | S | 6/2017 | Jackson et al. |
| D790,598 | S | 6/2017 | Furuki et al. |
| D791,843 | S | 7/2017 | Hashimoto et al. |
| D797,159 | S | 9/2017 | Yeu et al. |
| D799,561 | S | 10/2017 | Kumbhar et al. |
| D802,871 | S | 11/2017 | Knie |
| D811,449 | S | 2/2018 | Pfaff et al. |
| D814,531 | S | 4/2018 | Jacobsthal et al. |
| 9,988,786 | B2 | 6/2018 | Martin et al. |
| 2006/0243234 | A1 | 11/2006 | Shibuya |
| 2007/0003395 | A1* | 1/2007 | Segerljung ..... B66F 9/0655 414/227 |
| 2007/0104566 | A1 | 5/2007 | Layko et al. |
| 2007/0128012 | A1 | 6/2007 | Yamada et al. |
| 2009/0230749 | A1* | 9/2009 | Kostak ..... E02F 3/325 297/411.36 |
| 2011/0217151 | A1 | 9/2011 | Major et al. |
| 2015/0081178 | A1 | 3/2015 | Billaud et al. |

FOREIGN PATENT DOCUMENTS

| | | | |
|---|---|---|---|
| DE | 1781300 | A1 | 12/1970 |
| DE | 1759849 | A1 | 7/1971 |
| DE | 1784705 | A1 | 1/1972 |
| DE | 2759058 | C2 | 11/1983 |
| DE | 8423579 | U1 | 11/1985 |
| DE | 3540798 | A1 | 6/1986 |
| DE | 3429214 | C2 | 6/1987 |
| DE | 10119767 | A1 | 2/2002 |
| DE | 102006014876 | A1 | 11/2006 |
| EP | 0443828 | A1 | 8/1991 |
| EP | 045933 | A1 | 9/1991 |
| EP | 0474210 | B1 | 10/1996 |
| EP | 1081292 | A1 | 3/2001 |
| EP | 1131499 | B1 | 5/2003 |
| EP | 0909854 | B1 | 8/2006 |
| EP | 1325986 | B1 | 11/2010 |
| EP | 1897847 | B1 | 6/2012 |
| JP | 2009148167 | A | 7/2009 |
| WO | 2004104304 | A2 | 12/2004 |
| WO | 2012122581 | A1 | 9/2012 |

OTHER PUBLICATIONS

Invitation to Pay Additional Fees from the European Patent Office dated Apr. 24, 2018 for International Application No. PCT/US2016/066432 filed Dec. 14, 2017, 14 pages.

* cited by examiner

LOADER WITH TELESCOPIC LIFT ARM

CROSS-REFERENCE TO RELATED APPLICATION

The present application is based on and claims the benefit of U.S. provisional patent application Ser. No. 62/435,224, filed Dec. 16, 2016, and Ser. No. 62/571,491, filed Oct. 12, 2017, the contents of which are hereby incorporated by reference in their entireties.

BACKGROUND

The present disclosure is directed toward power machines. More particularly, the present disclosure is related to power machines having a telescoping lift arm. Power machines, for the purposes of this disclosure, include any type of machine that generates power for accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Some power machines include a lift arm structure which is pivotally attached to a frame of the power machine and controlled to rotate relative to the pivotal attachment by a lift actuator. A tool or implement, for example such as a bucket, coupled to a distal end of the lift arm structure is raised and lowered as the lift arm structure is rotated upward and downward. Depending on the geometry of various lift arm structures, such tool can be raised along a radial path or a generally vertical path. Some lift arm structures have a telescoping member to allow for variable lift arm paths. The discussion above is merely provided for general background information and is not intended to be used as an aid in determining the scope of the claimed subject matter.

SUMMARY

This discussion discloses various embodiments related to loaders having lift arms with a first portion or boom mounted to a frame of the loader and a second portion or arm mounted to the first portion and capable of slidably moving (commonly known as telescoping) relative to the first portion. In some exemplary embodiments, a power machine includes a frame and a lift arm structure having a first arm or boom pivotally mounted to the frame and a second or telescoping arm coupled to the boom and configured to extend from and retract into the boom. An implement interface is coupled to a distal end of the telescoping arm of the lift arm structure and is configured to mount an implement to the lift arm structure. A first actuator is coupled between the boom and the frame and is configured to raise and lower the boom, while a second actuator is coupled between the telescoping arm and the boom and is configured to extend and retract the telescoping arm relative to the boom. A control system of the power machine is configured to control the first and second actuators during a lift operation such that while the first actuator raises the boom, the second actuator extends and retracts the telescoping arm to maintain the implement interface or implement attached to the implement interface on a substantially linear path, for example a substantially vertical path throughout the lift operation.

In some exemplary embodiments, the power machine includes a first sensor configured to provide an output indicative of a position of the boom relative to a reference, such as the frame or gravity. The power machine also includes a second sensor configured to provide an output indicative of a position, or degree of extension, of the telescoping arm relative to the boom. In such embodiments, the control system can be configured to control the first and second actuators during the lift operation as a function of the outputs of the first and second sensors.

In other exemplary embodiments, the control system is configured to control the first and second actuators during the lift operation such that as the first actuator raises the boom from a lowered position to an intermediate position the second actuator retracts the telescoping arm to maintain the substantially linear or vertical path of the implement interface or the implement attached to the implement interface. The control system can also be configured to control the first and second actuators during the lift operation such that as the first actuator raises the boom upward from the intermediate position, the second actuator extends the telescoping arm to maintain the substantially linear or vertical path of the implement interface or the implement attached to the implement interface. Optionally, the path can be a defined preset path. For example, defined the preset path can include a substantially vertical path portion. The preset path can also include a path portion which extends beyond the vertical path portion in a direction which is non-parallel to the vertical path portion.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

DRAWINGS

DETAILED DESCRIPTION

Figure 1:
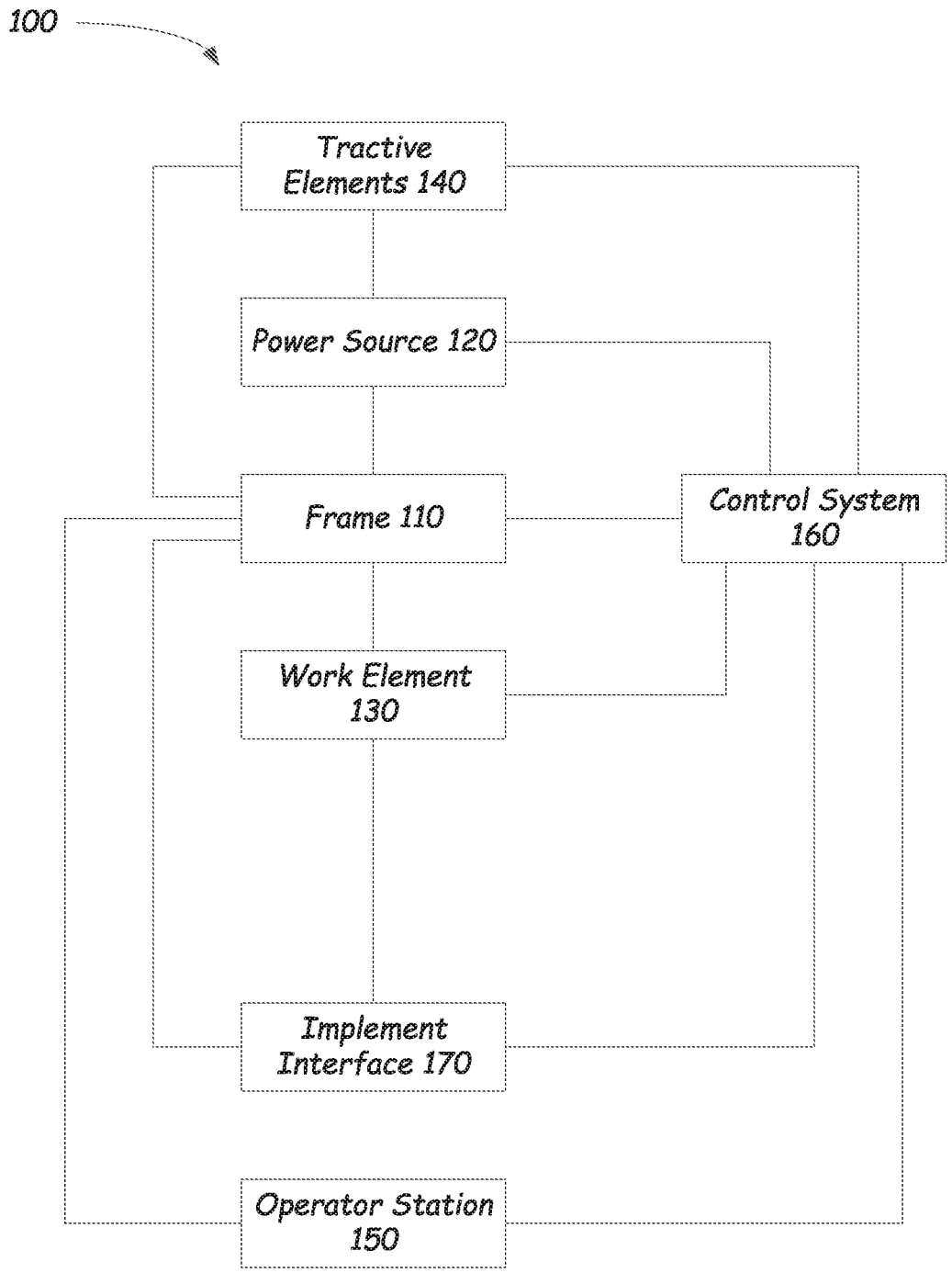
FIG. 1 is a block diagram illustrating functional systems of a representative power machine on which embodiments of the present disclosure can be advantageously practiced.

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed are embodiments of power machines, such as loaders, having a lift arm structure with a boom and a telescopic arm attached to the boom. In some embodiments, the boom section of the lift arm is pivotally mounted at a front side of the power machine and is raised under power of a first actuator such as a hydraulic lift cylinder. A second actuator such as a hydraulic telescopic cylinder controls extension and retraction of the telescopic portion of the lift arm structure relative to the boom. As the lift arm structure is raised or lowered using the lift actuator, the telescopic portion is extended or retracted to maintain a substantially linear implement lift path (i.e. the path of an implement that is mounted to the lift arm structure or, to reference a position on the power machine itself, the path of an implement interface to which an implement can be coupled) that is, in some embodiments, linear or more particularly, vertical, over at least a portion of a lift path of the boom portion of the lift arm structure. Lift position and telescoping position sensors are used to determine the positions of the boom and telescopic arm such that the lift and telescoping actuators can be employed to control the implement lift path.

In some disclosed embodiments, the telescoping portion of the lift arm is configured to be extended and retracted, without rotational movement of the boom section, to move the implement between a loading position and a carry position. The movement of the implement from the loading position to the carry position both moves the implement and carried load horizontally toward the power machine and vertically above a support surface. Such movement, which allows heavier loads to be carried without tipping the power machine, moves the center of gravity of the carried load closer to the front of the power machine. Movement of the implement from the loading position to the carry position, which can be an automatically controlled movement responsive to a single operator input, can also include automatic rollback of the implement using a tilt actuator. Further, in some disclosed embodiments, armrests of the power machine are configured to rotate upward from an operating position to allow operator station ingress and egress at both sides of the power machine.

These features, and the more general concepts, can be practiced on various power machines, as will be described below. A representative power machine on which the embodiments can be practiced is illustrated in diagram form in FIG. 1. FIG. 2 illustrates in diagram form portions of another embodiment of a power machine in which disclosed features and concepts can be practiced. FIGS. 3-12 illustrate other power machine embodiments in which disclosed features and concepts can be practiced. For the sake of brevity, only a few power machines are discussed. However, as mentioned above, the embodiments below can be practiced on any of a number of power machines, including power machines of different types from the representative power machine shown in FIGS. 1-12. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 2:
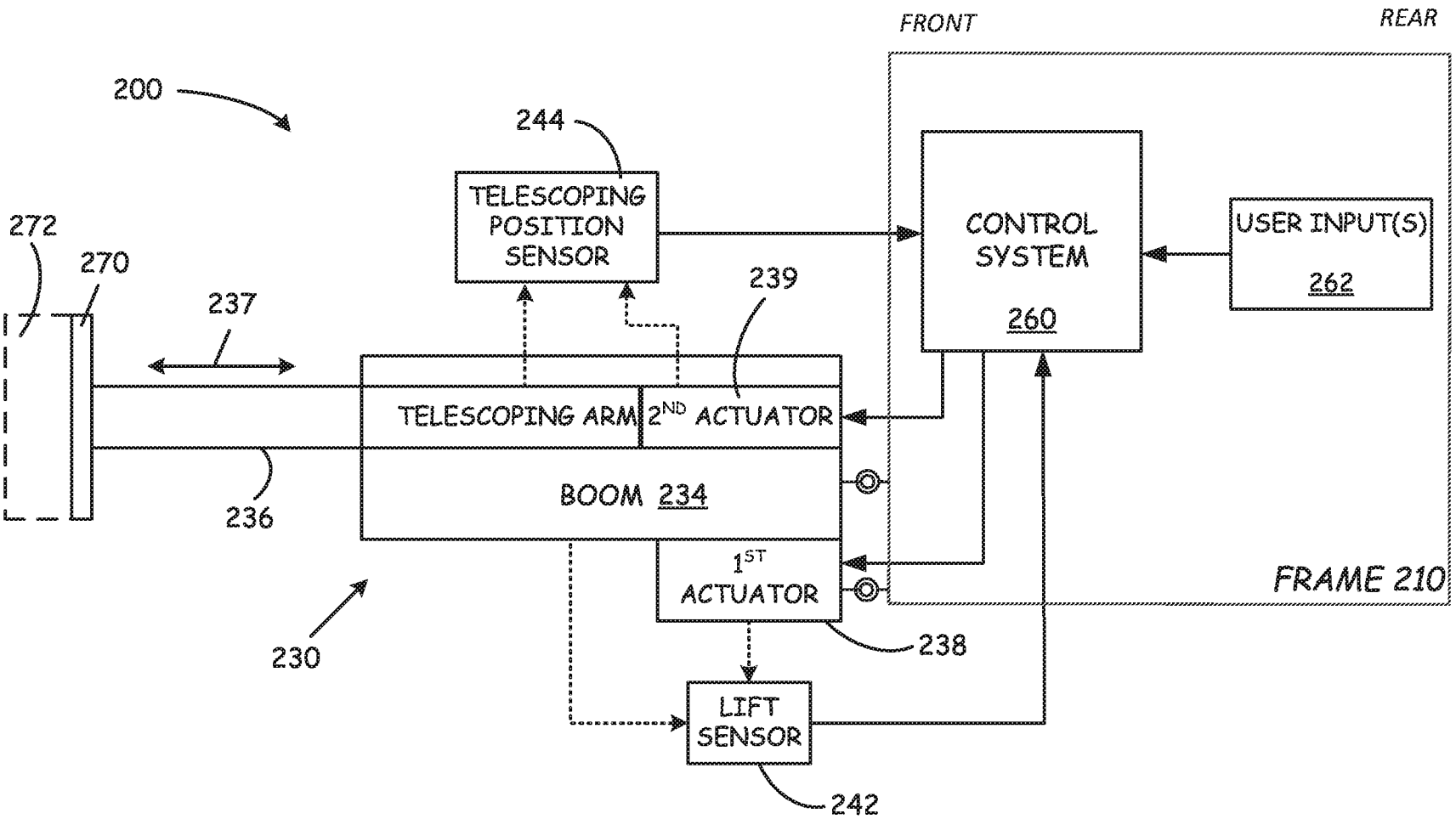
FIG. 2 is a block diagram illustrating functional systems of a portion of another representative power machine, on which embodiments of the present disclosure can be advantageously practiced, including a lift arm structure having a boom and a telescoping arm.

FIG. 1 is a block diagram illustrating the basic systems of a power machine 100 upon which the embodiments discussed below can be advantageously incorporated and can be any of a number of different types of power machines. The block diagram of FIG. 1 identifies various systems on power machine 100 and the relationship between various components and systems. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator. Control system 160 can include suitably programmed and configured processors, controllers and other circuitry, hydraulic valves and other hydraulic components, mechanical components, and other components and systems used to control functions of power machine 100.

Certain work vehicles have work elements that are capable of performing a dedicated task. The work element, i.e., the lift arm or lift arm structure can be manipulated to position an implement for the purpose of performing the task. The implement, in some instances can be positioned relative to the work element, such as by rotating a bucket relative to a lift arm, to further position the implement. Many work vehicles are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is capable of providing power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is capable of converting the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame. In example embodiments described below, tractive elements include track frame assemblies which are mounted to frame 110 using exemplary mounting structures and techniques.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote control device can be provided (i.e. remote from both the power machine and any implement to which is it coupled) that is capable of controlling at least some of the operator controlled functions on the power machine.

The description of power machine 100 is provided for illustrative purposes, to provide illustrative environments on which the embodiments discussed below can be practiced. While the embodiments discussed can be practiced on a power machine such as is generally described by the power machine 100 shown in the block diagram of FIG. 1, and the more particular power machine embodiments described below with reference to FIGS. 2-9, unless otherwise noted or recited, the concepts discussed below are not intended to be limited in their application to the environments specifically described.

FIG. 2 is a diagrammatic illustration of portions of a power machine 200 which can be a more particular embodiment of power machine 100 illustrated in FIG. 1, and can therefore include the components and systems described with reference to power machine 100. Only some components of power machine 200 are illustrated in order to better describe the disclosed concepts and features. Power machine 200 includes a frame 210 and a lift arm structure 230 pivotally mounted to a front side thereof. The lift arm structure 230 has both a first portion or boom 234 that is pivotally mounted to the frame 210 and a second portion or telescoping arm 236 that is movably engaged with the boom 234. A first actuator 238, which can be a hydraulic lift cylinder, is coupled between boom 234 and the frame 210 to cause boom 234 to rotate or pivot about its frame connection point. The telescoping arm 236 nests within boom 234 and is configured to be extended and retracted in the direction indicated by arrow 237 using a second actuator 239. The second actuator 239, which can also be a hydraulic cylinder, will typically be contained at least partially within and protected by boom 234. An implement carrier 270 at a distal end of telescoping arm 236 can be used to mount an implement 272 onto lift arm structure 230 and power machine 200. In an exemplary embodiment in which power machine 200 is a loader, implement 272 can be, for example, a bucket. The implement carrier 270 between implement 272 and telescoping arm 236 can be configured to allow removal of implement 272 from implement carrier 270. In some embodiments, a power machine may not have an implement carrier, such that any implement may be pivotally coupled directly to the lift arm.

A lift sensor 242 is operably coupled to one or both of boom 234 and the lift actuator 238 in order to monitor a position of boom 234 relative to the frame or to a reference such as a support surface. As such, lift sensor 242 can be an angular sensor which senses an angle of boom 234 relative to a reference position or plane. Lift sensor 242 can also be a linear sensor which senses an extent of extension or retraction of first actuator 238, or other types of sensors which can be used to monitor a position of boom 234. A telescoping position sensor 244 is similarly coupled to one or both of telescoping arm 236 and actuator 239 to monitor the extended and retracted position of telescoping arm 236 and thus of implement interface 270 or an attached implement 272.

Control system 260 of power machine 200 can include hydraulic control components and electronic machine control components. In exemplary embodiments, control system 260 is configured to control the first actuator 238 and the second actuator 239 to control the rotational raising and lowering of boom 234 and the extension or retraction of telescoping arm 236. Using inputs from lift sensor 242 and telescoping position sensor 244, control system 260 is configured in some embodiments to control second actuator 239 to extend and retract telescoping arm 236 while first actuator 238 lifts or lowers boom 234 such that a linear or vertical implement path is maintained. Control system 260 can maintain the linear or vertical implement path, as described in greater detail with reference to FIGS. 5-7, as a pre-set path which is maintained in response to inputs from a user input device 262.

Figure 3:
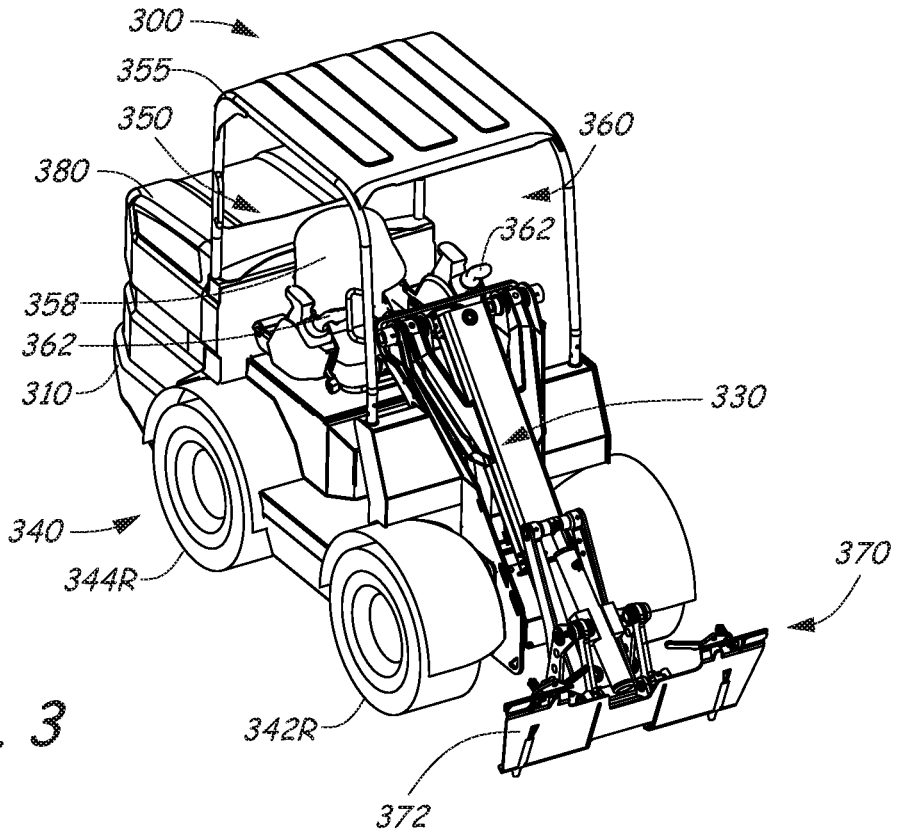
FIGS. 3-4 are perspective views of a loader on which features of the various embodiments discussed herein can be advantageously practiced.
Figure 4:
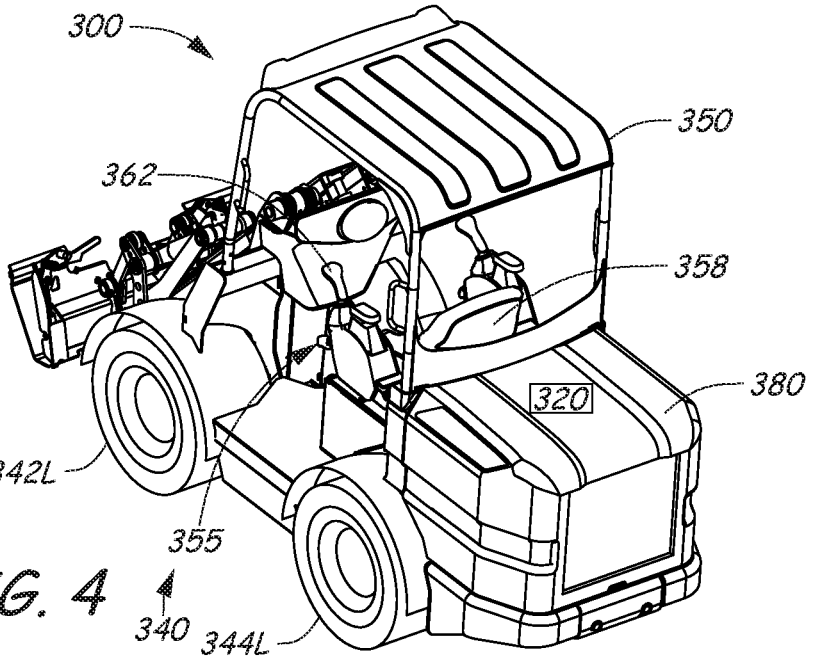

FIGS. 3-4 illustrate a loader 300, which is one example of the power machines 100 and 200 illustrated in FIGS. 1-2 where the embodiments discussed below can be advantageously employed. As loader 300 is one example of the power machines 100 and 200, features of loader 300 described below include reference numbers that are generally similar to those used in FIGS. 1-2. For example, loader 300 is described as having a frame 310, just as power machine 100 has a frame 110 and power machine 200 has a frame 210.

The loader 300 should not be considered limiting especially as to the description of features that loader 300 may have described herein that are not essential to the disclosed embodiments and thus may or may not be included in power machines other than loader 300 upon which the embodiments disclosed below may be advantageously practiced. Unless specifically noted otherwise, embodiments disclosed below can be practiced on a variety of power machines, with the loader 300 being only one of those power machines. For example, some or all of the concepts discussed below can be practiced on many other types of work vehicles such as various other loaders, excavators, trenchers, and dozers, to name but a few examples.

Loader 300 includes frame 310 that supports a power source 320 that can generate or otherwise providing power for operating various functions on the power machine. Power source 320 is shown in block diagram form, but is located within the frame 310. Frame 310 also supports a work element in the form of a lift arm assembly 330 that is powered by the power source 320 for performing various work tasks. As loader 300 is a work vehicle, frame 310 also supports a traction system, powered by power source 320, for propelling the power machine over a support surface. The power source 320 is accessible from the rear of the machine. A rear cover 380 covers an opening (not shown) that allows access to the power system 320 when the tailgate is an opened position. The lift arm assembly 330 in turn supports an implement interface 370 that provides attachment structures for coupling implements to the lift arm assembly.

The loader 300 includes a cab structure 355 that defines an operator station 350 from which an operator can manipulate operator input devices 362 to cause the power machine to perform various work functions. The operator station 350 includes an operator seat 358 and a plurality of operator input devices, including control levers 362 that an operator can manipulate to control various machine functions. Besides or in addition to the control levers 362, which in some embodiments are multiple axis joysticks, operator input devices can include buttons, switches, levers, sliders, pedals and the like that can be stand-alone devices such as hand operated levers or foot pedals or incorporated into hand grips such as the hand grips on control levers 362 or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 300 include control of the tractive elements 342L, 342R, 344L, and 344R (collectively 340), the lift arm assembly 330, and the implement carrier 372. Manipulation of the operator input devices can also cause the power machine to provide control signals to any implement that may be operably coupled to the implement carrier. Such signals can be in the form of electric (including wireless), hydraulic, mechanical, or some combination thereof.

Loaders can include human-machine interfaces including display devices that are provided at the operator station 355 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab, an operator compartment, or a seat. The operator position on such loaders is generally defined relative to a position where an operator is best suited and intended to manipulate operator input devices.

Various power machines that include and/or interact with the embodiments discussed below can have various frame components that support various work elements. The elements of frame 310 discussed herein are provided for illustrative purposes and frame 310 is not necessarily the only type of frame that a power machine on which the embodiments can be practiced can employ. The lift arm assembly 330 is illustratively pivotally pinned to a front portion of the frame 310. Connection of the lift arm assembly to the frame will be discussed in more detail below. Frame 310 also supports tractive elements in the form of wheels on either side of the loader 300.

The description of power machines 100, 200 and 300 above is provided for illustrative purposes, to provide illustrative environments on which the embodiments discussed below can be practiced. While the embodiments discussed can be practiced on a power machine such as is generally described by the power machines 100 and 200 shown in the block diagrams of FIGS. 1-2 and more particularly on a loader such as loader 300, unless otherwise noted or recited, the concepts discussed below are not intended to be limited in their application to the environments specifically described above.

Figure 5:
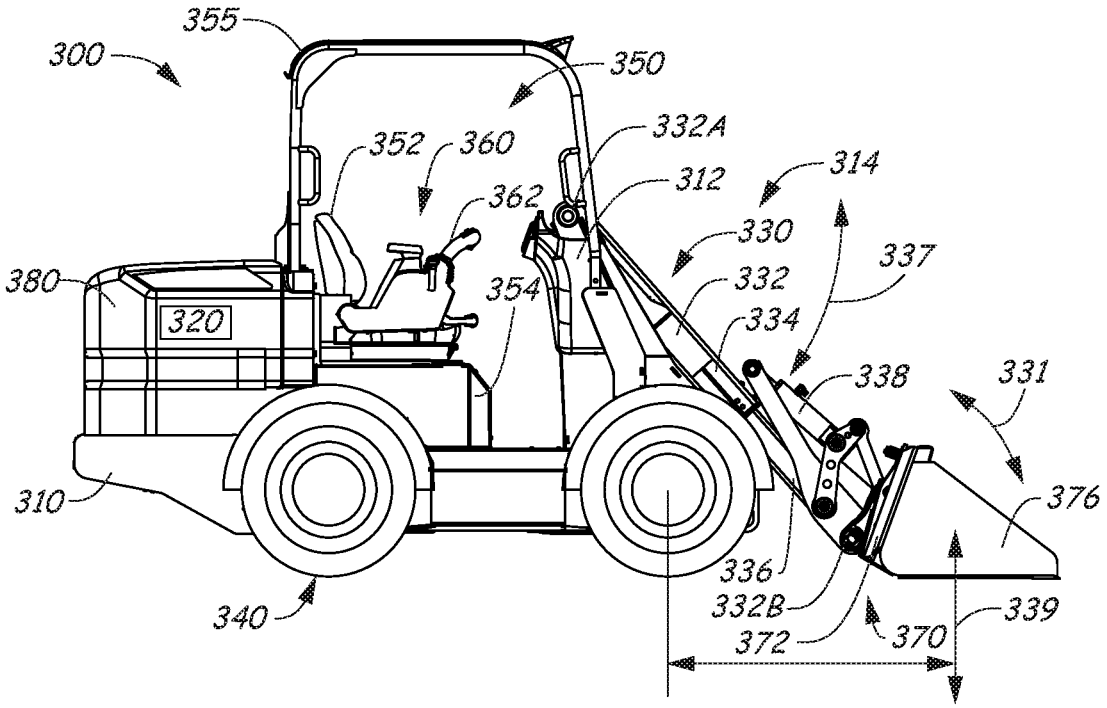
FIGS. 5-7 are diagrammatic side view illustrations of another representative power machine, having components of the power machines illustrated in FIGS. 1 and 2, in which the lift arm structure is controllable to maintain a vertical lift path of an implement or an implement interface.
Figure 6:
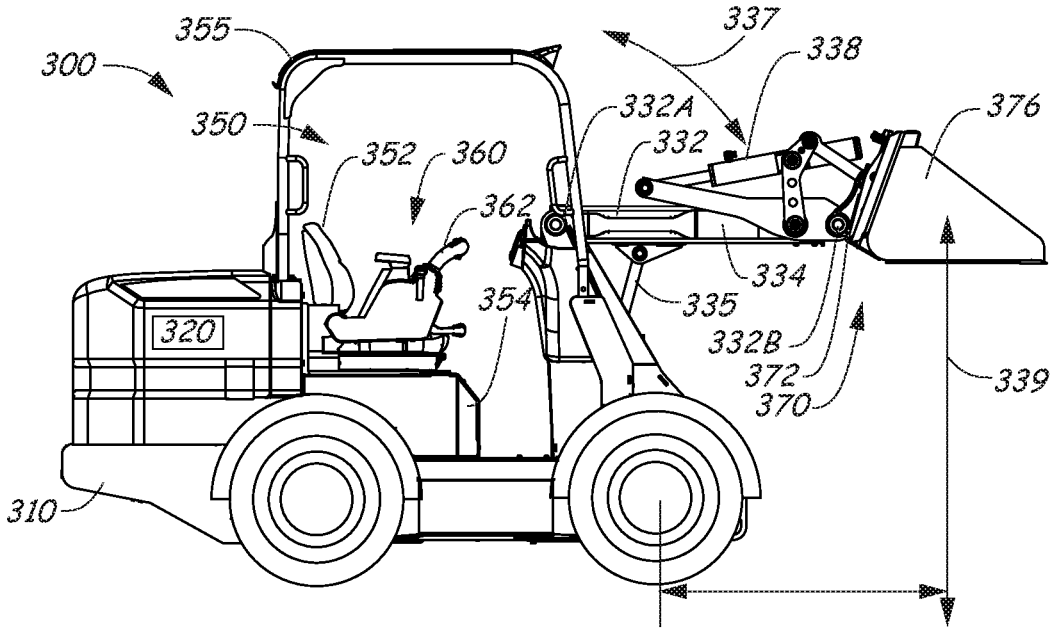
Figure 7:
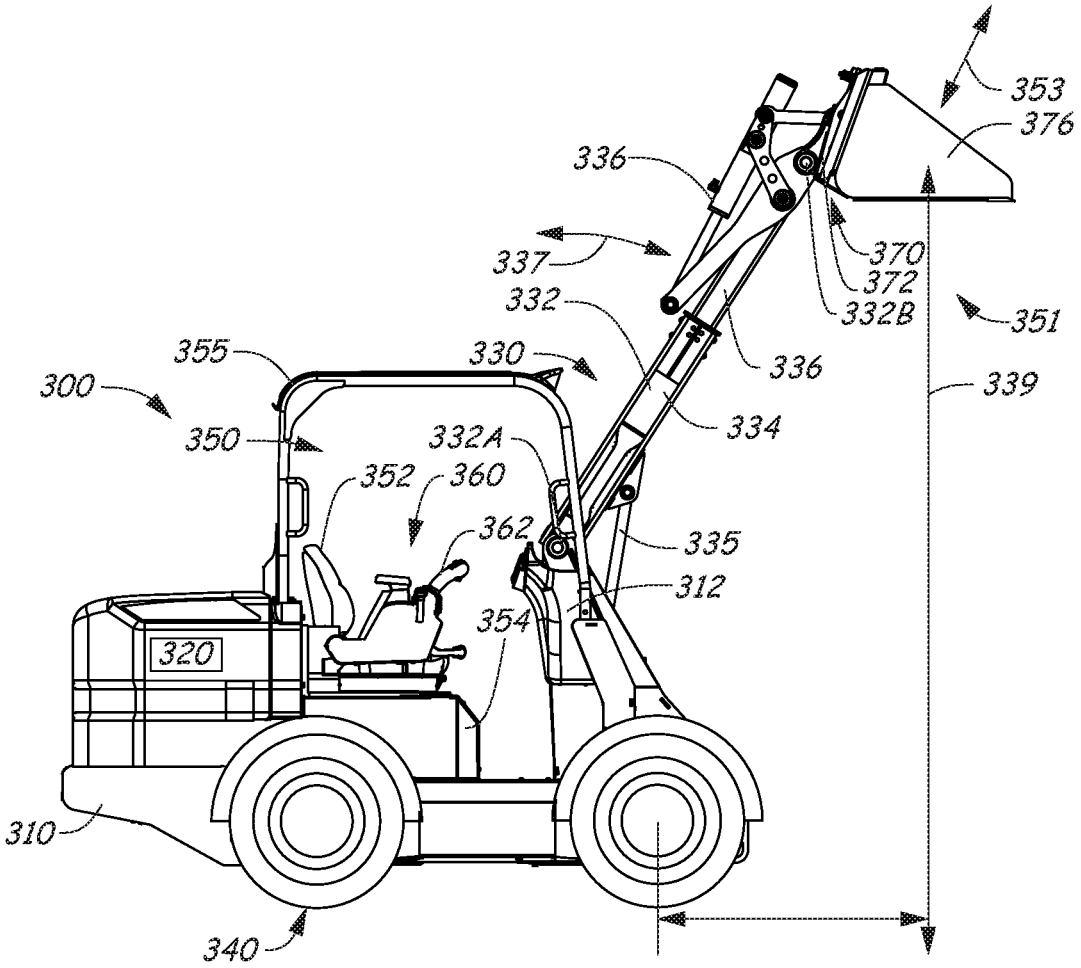

FIGS. 5-7 illustrate side views of power machine 300 with the lift arm assembly in various positions with respect to frame 310. In addition, a representative implement 376 is coupled to implement carrier 372 (a bucket is shown as one type of implement that can be coupled to the implement carrier). As illustrated, power machine 300 is a loader type of power machine, though the features described with reference to FIGS. 5-7 are not limited to use on loaders. Power machine 300 includes features, components and systems similar to those described with reference to FIGS. 1-2. Although some features, components and systems are not illustrated in FIGS. 5-7, those of skill in the art will recognize that these features, components and systems are included in power machine 300.

As shown in FIG. 5, power machine 300 includes a frame 310, a lift arm structure 330 coupled to the frame, tractive elements 340 which support the power machine on a support surface 352, and an operator station 350. Although not illustrated, power machine 300 includes components shown in power machines 100 and 200 such as a power source, a control system, etc. As with lift arm structure 230 shown in FIG. 2, lift arm structure 330 is a front mounted, telescopic lift arm 332 having a first or main portion 334 that is pivotally mounted to a tower 312 proximal to a front end 314 of the frame 310 and a second or telescoping arm portion 336 that is capable of being moved relative to the main portion 334. In some embodiments, telescoping arm portion 336 nests within the main portion 334.

An implement interface 370 is provided at a distal end of telescoping arm 336. The implement interface 370 is configured to operably couple an implement to the telescoping arm portion 336 and more generally to the power machine 300. Implement interface 370 can include an implement carrier 372, which allows implements to be removably attached to the implement carrier, or can be a simple connection point between telescoping arm 336 and an implement. A tilt actuator 338 is coupled to each of telescoping arm 336 and implement carrier 372 (or in the case where the implement interface does not include an implement carrier, to the implement itself). The tilt actuator is operable to control rotation of implement carrier 372 relative to telescoping arm 336. Implement interface 370 can also include an auxiliary power source (not shown) to which an implement can be coupled to provide any combination of hydraulic, electric (including wireless), and mechanical signals from the power machine to the implement.

Power machine 300 also includes a first or lift actuator 335 that is pivotally coupled to each of the frame 310 and main portion 334 of boom 330. With main portion 334 pivotally mounted to the tower 312, the boom 330 can be raised and lowered under the control of lift actuator 335. A second or telescoping actuator (see e.g., actuator 239 shown in FIG. 2) is coupled between main portion 334 and telescoping arm portion 336 to control extension and retraction of telescoping arm 336 relative to the main portion 334 of boom 330. As was the case with actuator 239 shown in FIG. 2, the telescoping actuator of power machine 300 can be partially or entirely contained within and protected by the structures of boom 330. In exemplary embodiments, raising and lowering of boom 330 with lift actuator 335, and extension and retraction of telescoping arm 336 with the corresponding telescoping actuator are controlled using the operator input devices 362 located within operator station 350 as shown in FIGS. 5-7. User input devices 362 can also be located elsewhere on power machine 300 or similar power machines, and can in some embodiments be located remotely from power machine 300. In some embodiments, user input devices 362 include a first input device for controlling the lift actuator and a second input device for controlling the telescoping actuator. The first and second input devices can be any acceptable type of input actuation devices such as the joystick levers 362. In some embodiments, the first and second input devices can be two axes of the same two-axis joystick. Other types of user inputs can be deployed. Signals from the first and second input devices are provided to a control system 360, which can process the signals as indicative of an operator's intention to move the lift arm assembly. Control system 360 is also in communication with first and second actuators to control actuation thereof as well as a boom position sensor and a telescoping position sensor (not shown in FIGS. 5-7), which provide indications of the position of the boom 334 and telescoping arm 336. In a first mode, the control system 360 controls movement of the first and second actuators (i.e., the lift actuator and the telescoping actuator) based directly on signals provided by the first and second input devices. In other words, movement of the first actuator is dependent on the signals received from the first input and movement of the second actuator is dependent on the signals from the second input.

In some embodiments, a second mode of operation is provided. In the second mode, a predefined implement path is defined and control of the first and second actuators are each dependent on actuation of the first input and the position of the boom and telescoping arm, as indicated by the boom position and telescoping arm position sensors. In this second mode, the lift and telescoping actuators are controlled to maintain an implement path in response to actuation of the first input along a pre-defined implement path that is substantially linear, for example, vertical, for at least part of the lift path of the boom. This implement path is described below as a vertical implement path, but will be understood to include other paths which may not be strictly vertical or even linear. In FIGS. 5-7, the implement path is illustrated by line segment 339 which can be substantially orthogonal to a ground or support surface 352. Control of the lift and telescoping actuators can be partially or completely automated to follow a pre-set path. To follow the pre-set path, power machine 300 also includes a lift sensor and a telescoping position sensor, neither of which is shown in FIGS. 5-7, of the type described above with reference to FIG. 2 so that the position of the main portion 334 and telescoping arm portion 336 of the lift arm structure 330 are known at all times.

Referring more specifically to FIG. 5, shown is main portion 334 of lift arm structure 330 in a lowered position, with the telescoping arm portion 336 extended to put the implement 376 on the ground or support surface 352. As the main portion 334 of lift arm structure 330 is raised to an intermediate position as shown in FIG. 6 following a radial path illustrated by arrow 337, telescoping arm portion 336 is retracted using the telescoping actuator to maintain the implement carrier 372 or the implement 376 along the substantially vertical implement path 339. From the intermediate lift arm structure position shown in FIG. 6, as the main portion 334 is moved upward toward the fully extended position shown in FIG. 7, the telescoping arm portion 336 is again extended to maintain the vertical implement path 339.

While the vertical implement path 339 can be maintained along the entire movement of lift arm structure 330 from the boom fully lowered position to the boom fully raised position, in other embodiments the vertical implement path 339 is only maintained for a portion of the lifting operation. Also, in some embodiments, a path 351 of the implement interface or of the implement includes the vertical implement path 339, but also extends beyond vertical in path portion 339, shown in FIG. 7 (e.g., to allow additional reach for dumping material, for example into a truck box or other location). For example, after main portion 334 is fully raised, telescoping arm portion 336 can, in some embodiments, be extended along path portion 353, which is not parallel to vertical path portion 339 in response to signals from the first input. Path portion 353 can also include retraction of telescoping arm portion 336 along path 339. This telescoping movement can be commanded by the first input at any position of main portion 334.

Figure 8:
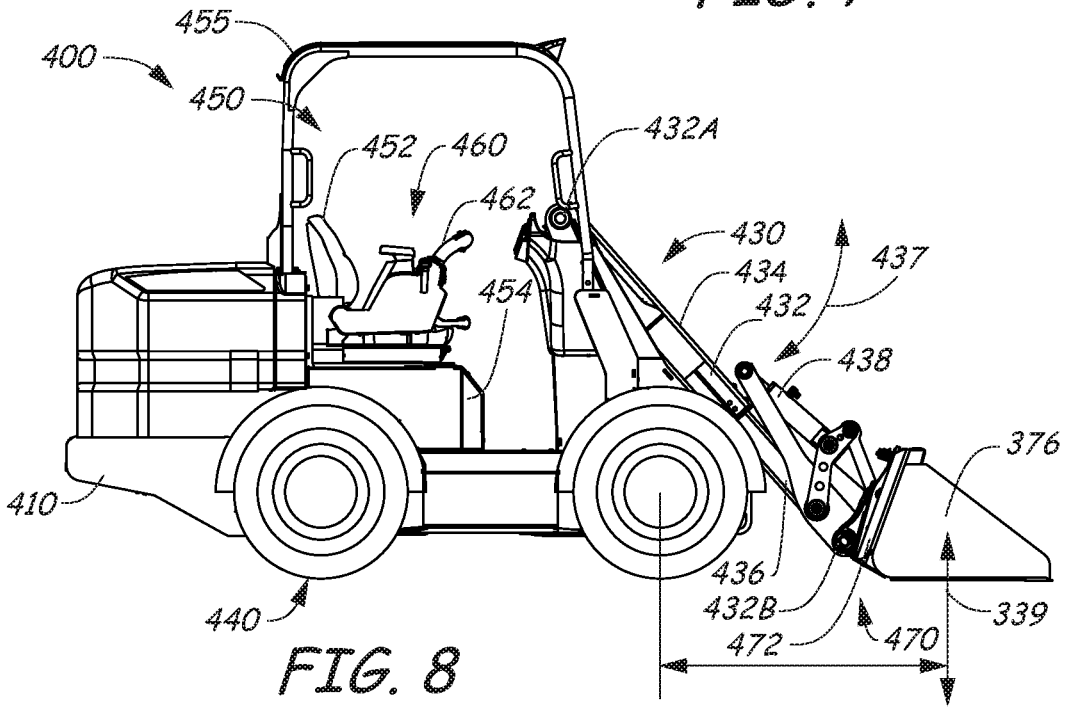
FIGS. 8-9 are diagrammatic side view illustrations of another representative power machine, having components of the power machines illustrated in FIGS. 1-7, in which the lift arm structure is controllable by extending and retracting a telescoping arm to move an implement and load horizontally and vertically between a loading position and a carry position.
Figure 9:
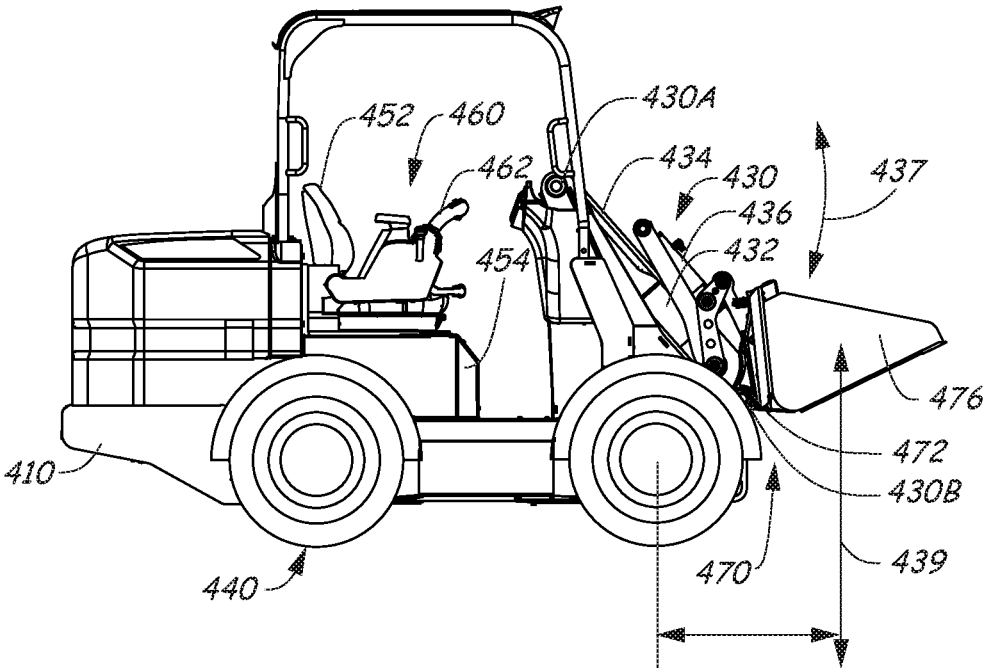

Referring now to FIGS. 8-9, shown is power machine 400 in accordance with exemplary embodiments. As illustrated, power machine 400 is a loader type of power machine similar (or identical) to power machine 300, although the features described and shown in FIGS. 8-9 may not be incorporated in power machine 300, nor are they necessarily limited for use on loaders. Power machine 400 includes features, components and systems similar to those described with reference to FIGS. 1-7. Although some features, components and systems are not illustrated in FIGS. 8-9, those of skill in the art will recognize that these features, components and systems are included in power machine 400.

As shown in FIG. 8, power machine 400 includes a frame 410, a lift arm structure 430 coupled to the frame, tractive elements 440 which support the power machine on a support surface, and an operator compartment 450. As was the case with power machine 300, although not illustrated in FIG. 7, power machine 400 includes components shown in power machines 100 and 200 such as a power source, a control system, etc. As with lift arm structures 230 and 330, lift arm structure 430 is a front mounted, telescopic lift arm having a first or main portion 434 that is pivotable relative to the frame 410 and a second or telescoping arm portion 436 that is configured to be moved linearly relative to the main portion 434. In some embodiments, telescoping arm portion 436 nests within main portion 434.

An implement interface 470 is provided at a distal end of telescoping arm 336. The implement interface 370 is configured to operably couple an implement to the telescoping arm portion 336 and more generally to the power machine 300. At a distal end of telescoping arm portion 436, an implement interface 470 is configured to couple an implement 476 to the arm. As was the case with implement interface 370, implement interface 470 can include an implement carrier 472 that allows implements to be removably attached to the implement carrier, or can be a simple connection point between telescoping arm 436 and an implement 472. A tilt actuator 438 is coupled to each of telescoping arm 436 and implement interface 470. The tilt actuator is operable to control rotation of implement 472 relative to telescoping arm 436.

Although not shown in FIGS. 8-9 due to positioning of the lift arm structure 430, power machine 400 also includes a first or lift actuator, similar to lift actuator 335, that is pivotally coupled to each of the frame 410 and main portion 434. With the main portion 434 of lift arm structure 430 pivotally mounted to the front of frame 410, the main portion 434 can be raised and lowered under the control of the lift actuator along a radial path approximated by arrow 437. A second or telescoping actuator (see e.g., actuator 239 shown in FIG. 2) is coupled between the main portion 434 and the telescoping arm portion 436 to control extension and retraction of telescoping arm portion 436 relative to the main portion 434. As was the case with actuator 239 shown in FIG. 2, the telescoping actuator portion 436 of power machine 400 can be partially or entirely contained within and protected by the structure of main portion 434.

In exemplary embodiments, raising and lowering of main portion 434 with the lift actuator 435, and extension and retraction of telescoping arm 436 with the corresponding telescoping actuator are controlled using operator input devices 462 located within operator compartment 450. Input devices 462 can also be located elsewhere on power machine 400 or similar power machines, and can in some embodiments be located remotely from power machine 400. In some embodiments, user input devices 462 include a first input device for controlling the lift actuator and a second input device for controlling the telescoping actuator. The first and second input devices (neither of which is shown in FIGS. 8-9) can be any acceptable type of input actuation devices. In some embodiments, the first and second input devices can be two axes of the same two-axis joystick. Other types of user inputs can be employed. Signals from the first and second input devices are provided to a control system 460, which can process the signals as indicative of an operator's intention to move the lift arm assembly. Control system 460 is also in communication with the first and second actuators to control actuation thereof as well as a boom position sensor and a telescoping position sensor (shown in FIG. 2), which provide indications of the position of the main portion 434 and telescoping arm portion 436. As was the case with control system 360, in one mode, the control system 460 controls movement of the first and second actuators based directly on signals provided by the first and second input devices. In other words, movement of the first actuator is dependent on the signals received from the first input and movement of the second actuator is dependent on the signals from the second input.

Like control system 360 of power machine 300, control system 460 can also be configured to function in the above-discussed second mode of operation to control the lift arm structure 430 to maintain movement of the implement 472 or implement interface 470 along a predefined implement path, such as a partially or completely linear lift path, a vertical lift path, etc. As such, power machine 400 includes a lift sensor and a telescoping position sensor (not shown in FIGS. 8-9) of the type described above with reference to FIG. 2 so that the position of the main portion 434 and telescoping arm portion 436 are known at all times. Such predefined lift paths can be achieved by extending and retracting the telescoping arm 436 as the main portion 434 is raised or lowered in a manner such as described with reference to FIGS. 5-7.

In an exemplary embodiment, disclosed power machines, such as power machine 400, are further configured to move the implement 476 and a carried load from a loading position (shown in FIG. 8) to a carry position (shown in FIG. 9) without requiring actuation of the first or lift actuator and corresponding pivotal movement of main portion 434 relative to frame 410. Movement of the implement 476 and a carried load from the loading position to the carry position is achieved by using the second actuator (e.g., actuator 239 shown in FIG. 2) to retract the telescoping arm portion 436, and thereby both lifting the implement and load above the ground and moving the center of gravity (COG) of the load closer to the front wheel of the power machine.

FIG. 8 illustrates power machine 400 with main portion 434 lowered and with telescoping arm portion 436 extended to place implement 476 in a loading position. In one example embodiment, in the loading position of implement 476, main portion 434 is fully lowered, but this need not be the case for all loading positions. Also, in the illustrated loading position, telescoping arm portion 436 is extended to position implement 476 against the support surface, but this need not be the case in all embodiments or in all loading positions. With implement 476 in the loading position, the center of gravity of the carried load is positioned a first distance in front of front wheels, with the first distance represented by reference number 482.

FIG. 9 illustrates power machine 400 with main portion 434 still lowered and with telescoping arm portion 436 retracted to place implement 476 in a carry position. In the illustrated carry position, the implement 476 and carried load are lifted off the support surface to aid in transport of the load, and the center of gravity of the carried load is positioned a second distance, less than the first distance, in front of front wheels. The second distance is represented by reference number in FIG. 9.

By implementing both vertical and horizontal movement of the implement and load through retraction of the telescoping arm portion 436, the load is pulled closer to the machine 400 to a carry position during a transport condition, and the center of gravity of the load is moved closer to the front wheel of the machine. This improves lift capacity for the power machine due to the fact that the load will not cause the machine to tip forward as easily. Also, in exemplary embodiments, when moving the implement from the loading position to the carry position, implement 476 (e.g., a bucket) can be raised or rolled back using tilt actuator 438 to aid in preventing the implement from engaging the support surface while moving and/or to aid in keeping the load on or in the implement. In exemplary embodiments, in the carry position the bottom of the bucket or implement is raised above the ground or support surface, solely by retraction of the telescoping arm portion 436, by various distances as required for a particular machine configuration or task. In exemplary embodiments, in the carry position achieved by retraction of the telescoping arm portion 436, the bottom of the bucket or implement is raised to a position a minimum of 10 centimeters above the ground. However, in other exemplary embodiments, in the carry position the bottom of the bucket or implement (and the implement interface) is raised a minimum of 20 centimeters above the ground. In still other exemplary embodiments, the bottom of the implement and implement interface is raised significantly further above the ground by the retraction of the telescoping arm portion 436. For example, in some particular embodiments, it has been found to be beneficial to configure the power machine such that in the carry position the bottom of the implement and implement interface is raised at least 50 centimeters above the ground. Further, it has been discovered that a carry position, achieved by retraction of the telescoping arm portion, having the bottom of the implement and implement interface raised above a level of the front axle of the power machine is particularly beneficial in some embodiments.

In some embodiments, movement from the loading position to the carry position, by retracting the telescoping arm portion 436 is performed as a third or auto-carry mode of operation. In the auto-carry mode of operation, a single operator command using a user input device will cause the control system 460 to move the implement into the carry position from the loading position. Further, in some embodiments, the single operator command can cause the tilt actuator 438 to roll the implement back as discussed above. Also, in some embodiments, a single operator command can cause main portion 434 to lower and telescoping arm portion 436 to extend to automatically place implement 476 into the loading position.

Figure 10:
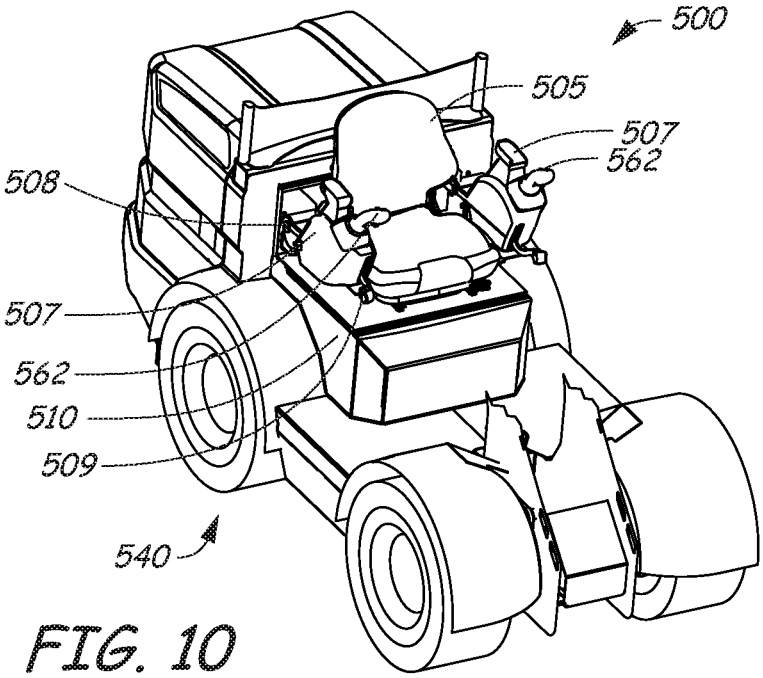
FIGS. 10-11 are diagrammatic perspective view illustrations of another representative power machine having armrests configured to allow ingress and egress from both sides of the power machine.
Figure 11:
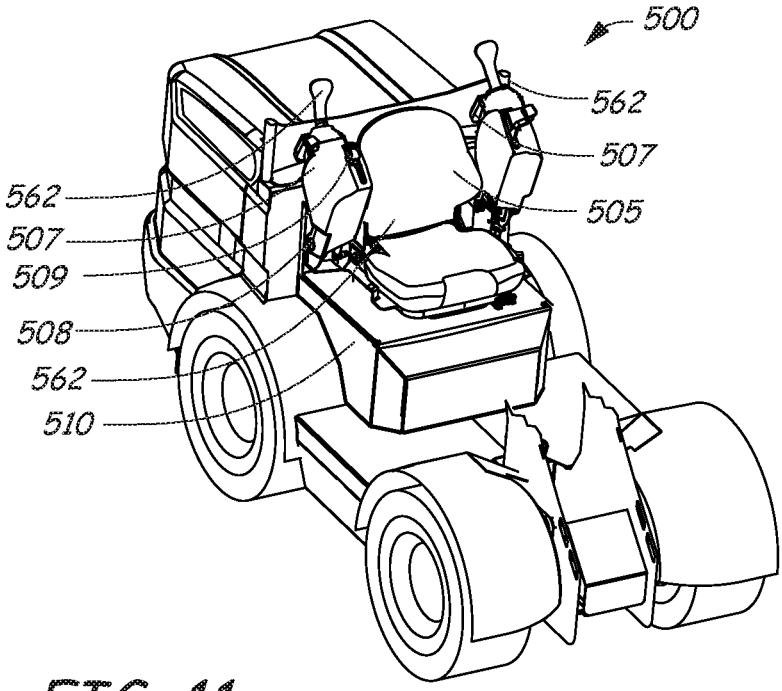

Referring now to FIGS. 10-11, shown is a portion of a power machine 500 which can have features similar to power machines 100, 200, 300 and/or 400 described above. Although power machine 500 can include any of the above-discussed features, not all components supporting these features are included in FIGS. 10-11. For instance, the lift arm structure and cab structure of power machine 500 are omitted to more clearly illustrate other features as described below.

Power machine 500 has an operator station 550 (with the cab removed in FIGS. 10-11) with an operator seat 505. Armrests 507 are positioned on each side of seat 505. In some embodiments, armrests 507 support operator input devices 562. Each of armrests 507 is pivotally mounted at a pivot connection 508 to a portion of frame 510 or to other portions of power machine 500. Although pivotally mounted to frame 510, armrests 507 can be locked in a lowered or operating position as shown in FIG. 10.

Each of armrests 507 also include a release mechanism 509 configured to unlock the armrest from its lowered position. Once unlocked, the armrest can be raised to a position as shown in FIG. 11 that allows ingress to, or egress from, the operator seat. By having both of armrests 507 configured to be raised and lowered in this manner, ingress into the operator station, and egress from the operator station, can be achieved from either side of the power machine. Ingress and egress can be accomplished by raising either of the armrests 507 and it need not be the case that both armrests be raised to enter or exit the operator seat. By allowing for ingress and egress from either side of the machine, an operator can access the machine or leave it when an obstacle is blocking one side of the machine.

Figure 12:
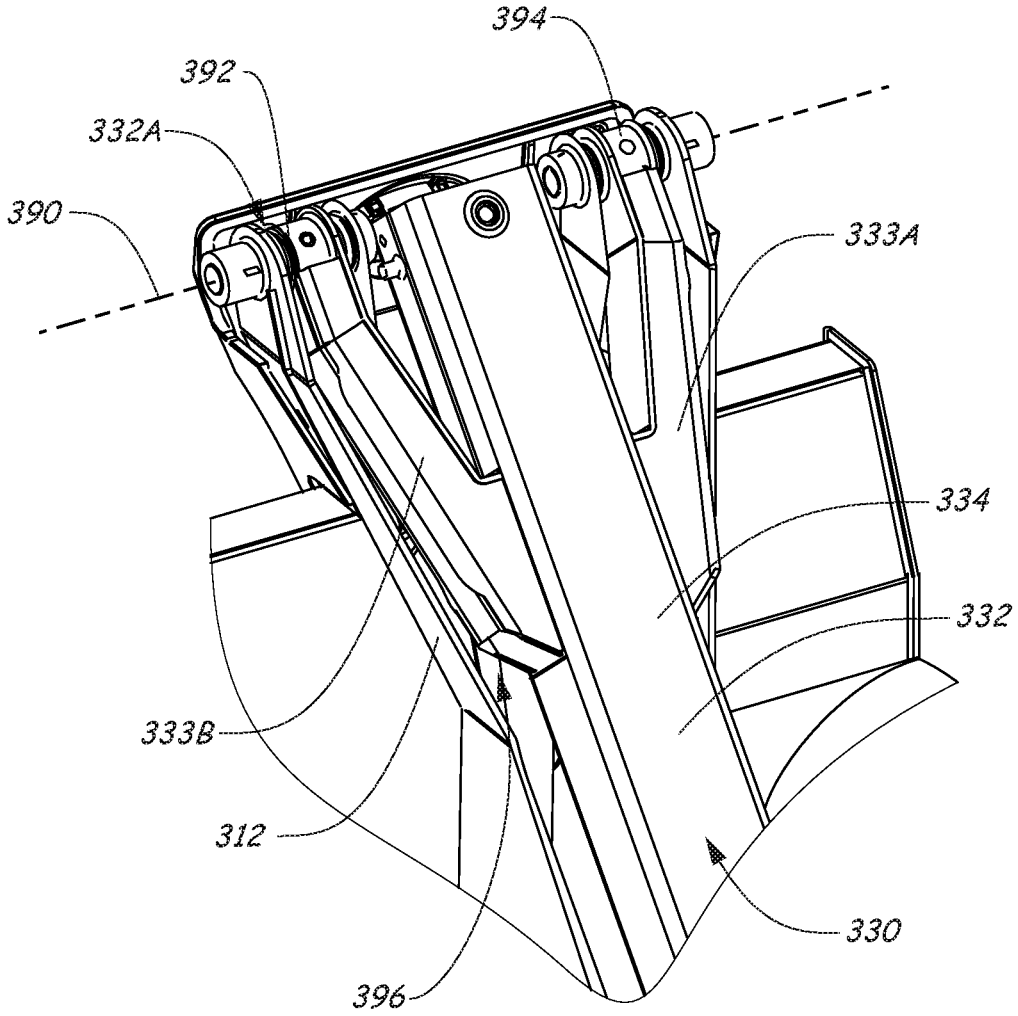
FIG. 12 is a perspective view of a portion of the representative power machine of FIGS. 3-4 illustrating a portion of the lift arm structure and a portion of the frame of the power machine to which it is pivotally mounted.
Figure 13:
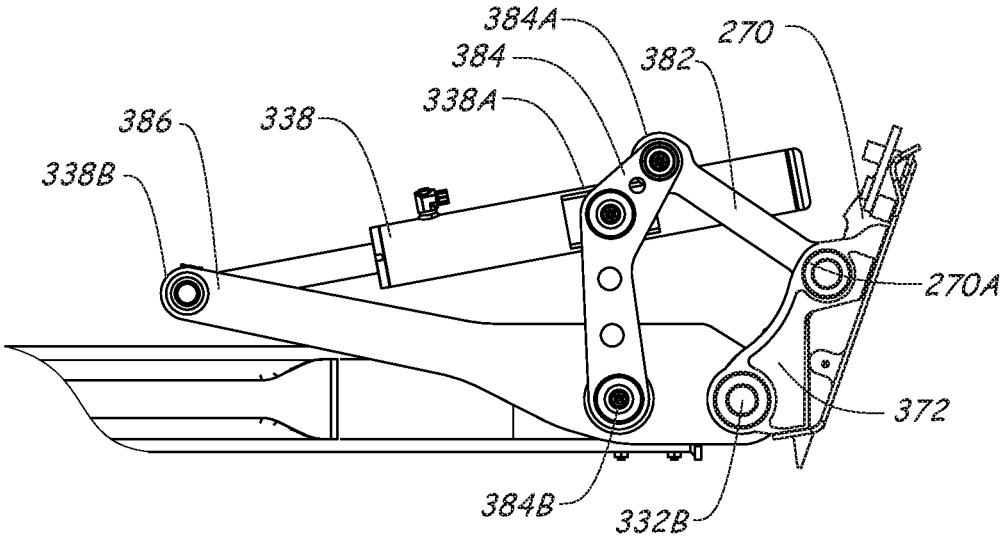
FIG. 13 is a side view of a linkage between a lift arm structure and an implement interface according to one illustrative embodiment.

FIG. 12 illustrates a portion of lift arm structure 330 according to one illustrative embodiment. While the portions of the lift arm structure 330 shown in FIG. 12 illustrate an advantageous connection structure for pivotally mounting the lift arm structure 330 to the tower 312, in some embodiments, other lift arm mounts can be used. Lift arm structure 330, as discussed above, has a main portion 334 and a pair of wings 333A and 333B that are attached to the main portion. Each of the wings 333A and 333B are attached to the tower 312 at pivot joints 394 and 392, respectively. The main portion 334 is otherwise unattached to the tower 312. The pivot joints 394 and 392 are aligned along an axis 390 so that the main portion 334 pivots about axis 390. The pivot joints 394 and 392 are generally at end 332A of the lift arm structure 330. It has been found that the use of wings 392 and 394 to mount lift 332 to the frame advantageously provides improved stability of the lift arm structure 330 when under, for example, side load or torsional load and reduces the likelihood of a twisting of the lift arm structure under such loads.

FIGS. 13-16 illustrate a linkage structure 390 for pivotally coupling tilt cylinder 338 to the lift arm structure 330 to the implement interface 270 and more particularly implement carrier 272 according to one illustrative embodiment. The linkage structure 390, although shown on lift arm structure 330, is but one embodiment of a linkage structure that can be coupled to the lift arm structure 330. In other embodiments, other types of coupling schemes and mechanisms can be used to couple a tilt cylinder to an implement carrier. The linkage structure 390 advantageously provides a compact arrangement and allows a large angle of rotation between a fully extended position and a fully retracted position of the tilt cylinder 338. The implement carrier 272 is pivotally mounted to the telescoping arm portion 336 at joint 332B. The linkage structure 390 includes a bracket 386 to which a rod end of the tilt cylinder 338 is pivotally mounted at joint 338B. The bracket 386 is mounted to the telescoping arm portion 436 and extends away from the implement carrier 372. That is, the bracket 386 is mounted on one end to the telescoping arm portion 436 and extends toward a free end that extends toward and, depending on how far the telescoping arm portion is extended, over the main portion 334 of the lift arm.

A base end of the tilt cylinder 338 is mounted to a pair of links 384 that are pivotally coupled to the bracket 386, each of which pivots about joint 384B. Thus, when the tilt cylinder 338 is extended and retracted, the rod end of the tilt cylinder 338 is held in position relative to bracket 386, while the base end of the tilt cylinder pivots the links 384 about the pivot joint 384B. Links 384 are each pivotally coupled to a pair of links 382 at joints 384A. Links 382 are in turn pivotally coupled to the implement carrier 372 at joint 372A to transfer linear movement of the tilt cylinder 388 into rotational movement of the implement carrier 372 about joint 332B.

Figure 14:
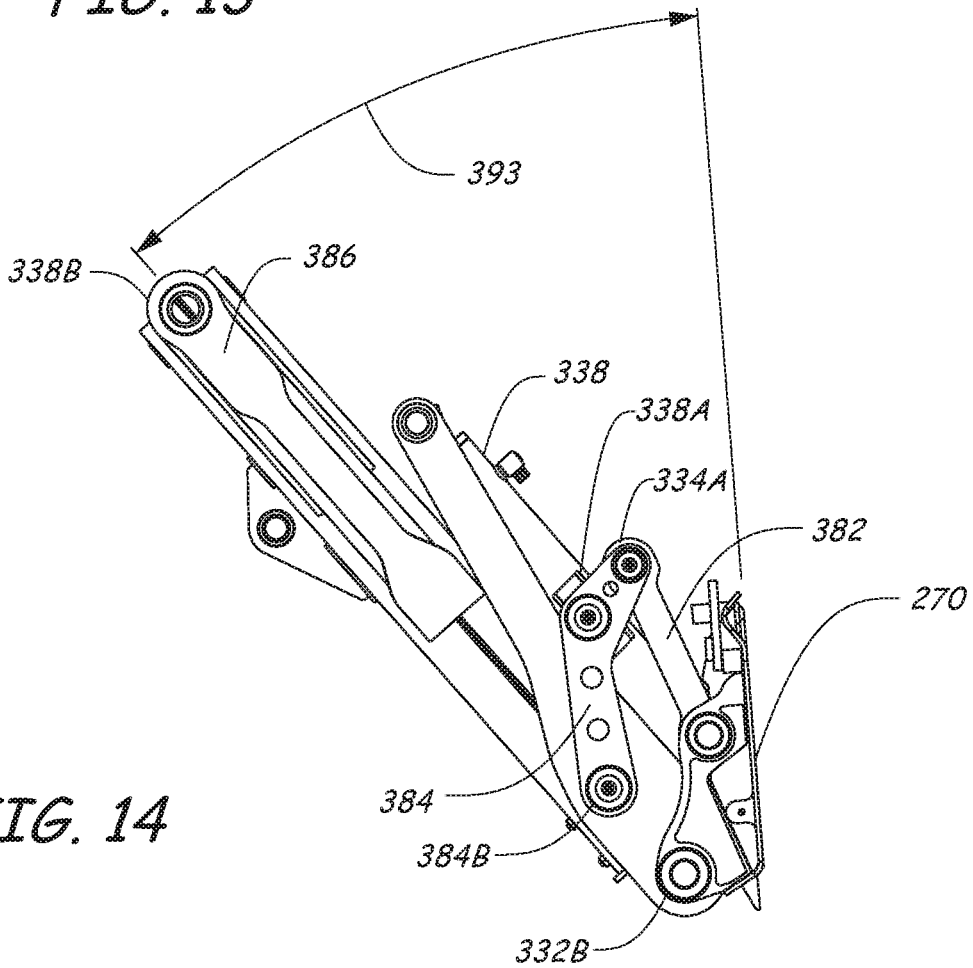
FIG. 14 illustrates the linkage of FIG. 13 with a tilt cylinder fully retracted.
Figure 15:
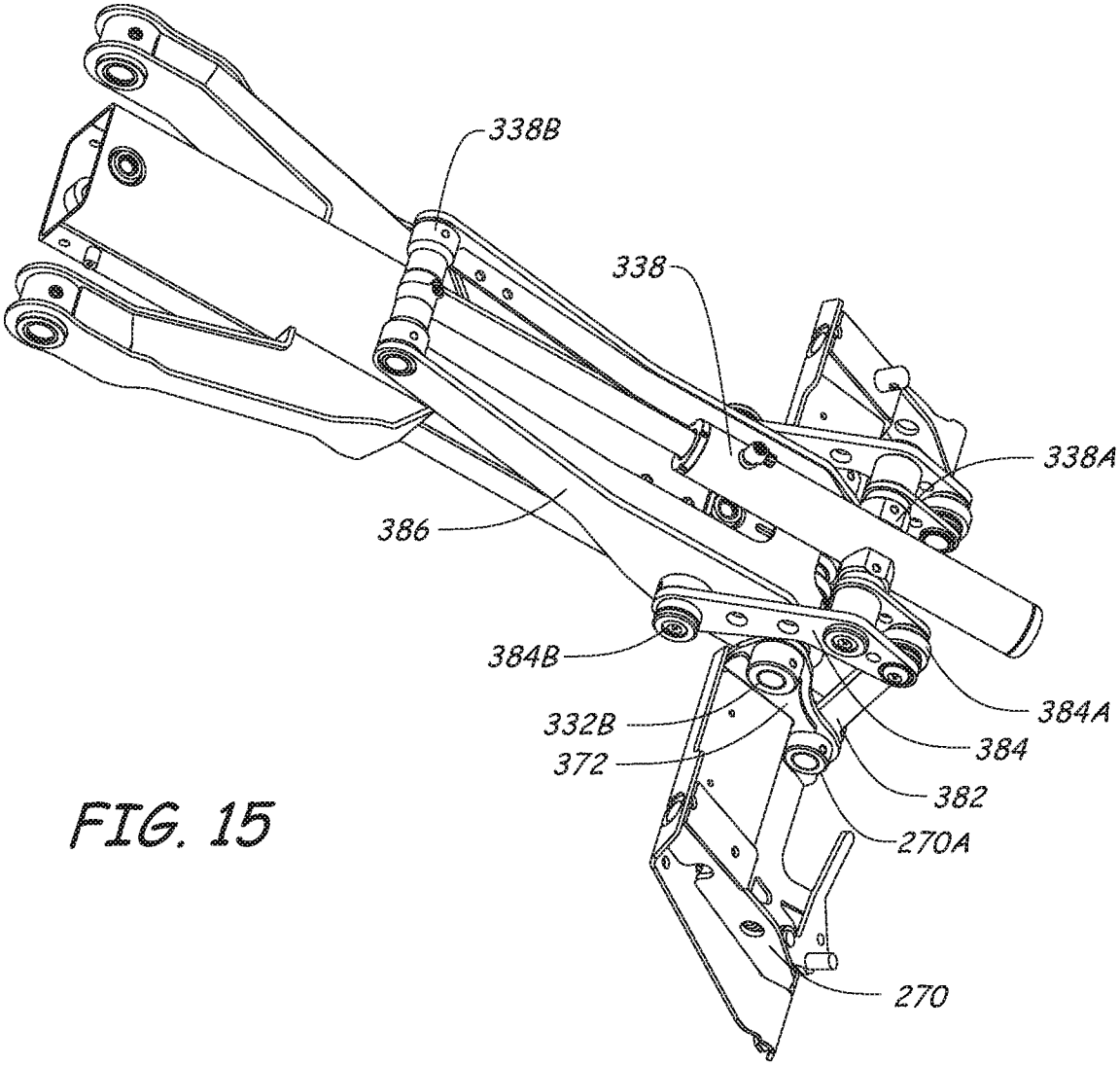
FIG. 15 is a perspective view of the linkage of FIG. 13.
Figure 16:
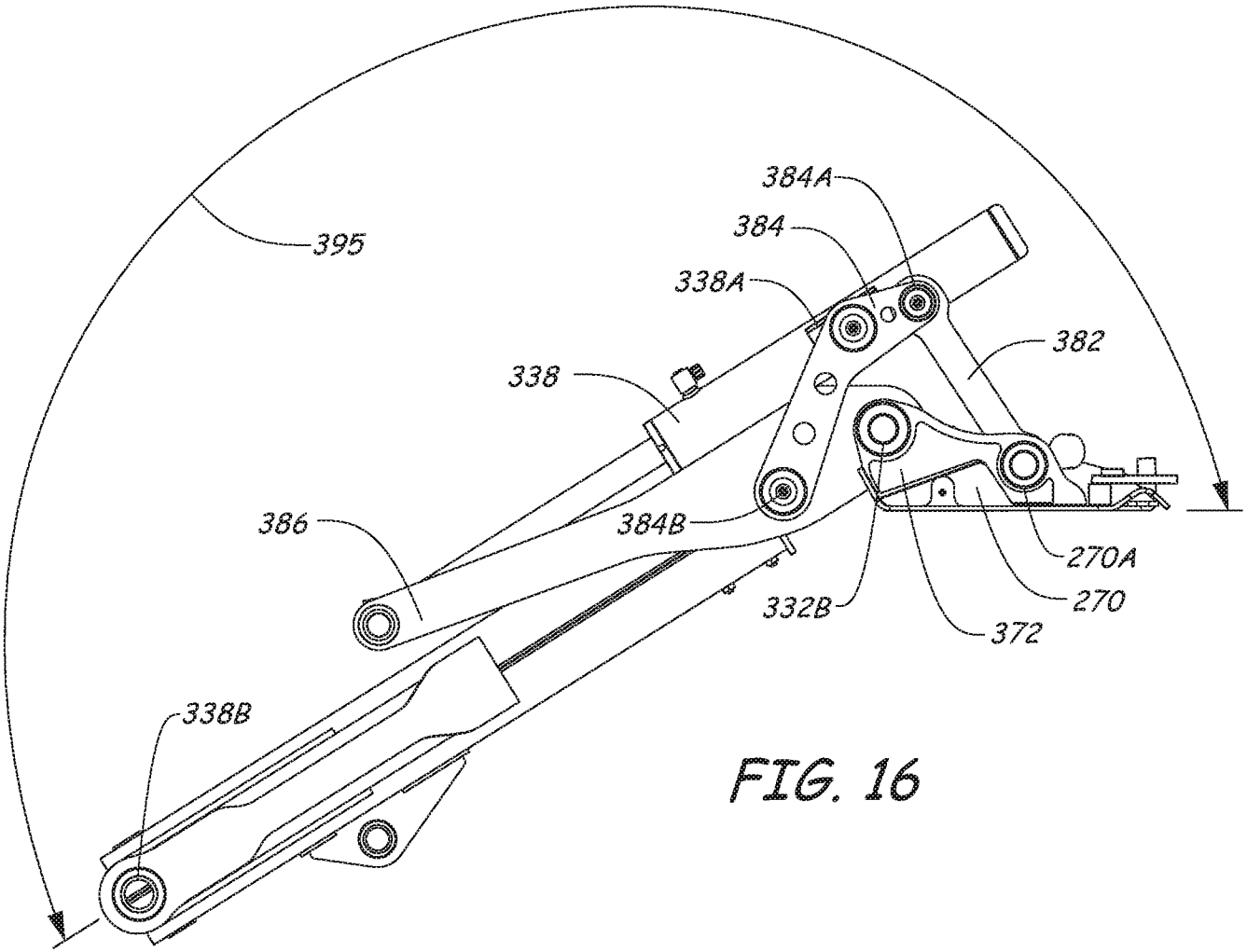
FIG. 16 illustrates the linkage of FIG. 13 with the tilt cylinder fully extended.

FIG. 14 illustrates a condition where the tilt cylinder 338 is fully retracted, showing a minimum angle 393 between the lift arm structure 330 and the implement carrier 372. This angle is preferably less than about 50 degrees and more preferably about 37 degrees. FIG. 15 illustrates a condition where the tilt cylinder 338 is fully extended, showing a maximum angle 395 between the lift arm structure 330 and the implement carrier 372. This angle is preferably more than 200 degrees and more preferably about 220 degrees, such that the range of motion of the implement carrier between the minimum angle and the maximum angle is at least 150 degrees and more preferably about 170 degrees.

The linkage structure shown in FIGS. 13-16 provide several advantages. Among these advantages is a range of motion sufficient to allow for maintaining a given attitude of the implement carrier with respect the ground throughout the range of motion of the main lift arm and telescoping arm portions of the lift arm structure. In addition, by having a bracket that extends back from the attachment point thereof to the telescoping arm portion, this range of motion is achieved without wasting length of the telescoping portion on the positioning of the tilt cylinder. Thus, the linkage advantageously accomplishes a large range of motion of the implement carrier pivoting as well as allowing for a large amount of extension and retraction of the telescoping arm portion relative to its overall length.

Although the present invention has been described with reference to preferred embodiments, workers skilled in the art will recognize that changes may be made in form and detail without departing from the spirit and scope of the invention.

What is claimed is:

1. A power machine comprising:

a frame;

a cab mounted on the frame;

a lift arm structure having a boom pivotally mounted to a front of the frame at a pivot connection position substantially forward of the cab, the lift arm structure having a telescoping arm coupled to the boom and configured to extend from and retract into the boom;

an implement interface coupled to a distal end of the telescoping arm of the lift arm structure and configured to mount an implement to the lift arm structure;

a first actuator coupled between the boom and the frame and configured to raise and lower the boom;

a second actuator coupled between the telescoping arm and the boom and configured to extend and retract the telescoping arm relative to the boom;

a control system including a controller configured to control the first and second actuators during a lift operation such that the first actuator raises the boom and such that the second actuator extends and retracts the telescoping arm to maintain a substantially vertical path of the implement interface or the implement attached to the implement interface throughout the lift operation; and a first sensor configured to provide an output indicative of a position of the boom relative to a reference and a second sensor configured to provide an output indicative of a position of the telescoping arm relative to the boom, and wherein the control system is configured to control the first and second actuators during the lift operation as a function of the outputs of the first and second sensors.

2. The power machine of claim 1, wherein the control system is configured to control the first and second actuators during the lift operation such that as the first actuator raises the boom from a lowered position to an intermediate position the second actuator retracts the telescoping arm to maintain the substantially vertical path of the implement interface or the implement attached to the implement interface.

3. The power machine of claim 2, wherein the control system is configured to control the first and second actuators during the lift operation such that as the first actuator raises the boom upward from the intermediate position the second actuator extends the telescoping arm to maintain the substantially vertical path of the implement interface or the implement attached to the implement interface.

4. The power machine of claim 3, and further comprising at least one operator input device coupled to the control system and wherein the control system is configured to control the first and second actuators during the lift operation, responsive to input from the at least one operator input device, to maintain the substantially vertical path of the implement interface or the implement attached to the implement interface.

5. The power machine of claim 1, wherein the control system is configured to control the first and second actuators during the lift operation such that the implement interface or the implement attached to the implement interface follows a preset path including the substantially vertical path.

6. The power machine of claim 5, wherein the preset path extends beyond the substantially vertical path.

7. The power machine of claim 5, wherein the preset path includes a path portion which is not parallel to the substantially vertical path.

8. The power machine of claim 1, wherein the control system is configured to control the second actuator to move the implement interface or the implement attached to the implement interface both vertically and horizontally from a loading position to a carry position without movement of the boom by the first actuator.

9. A power machine comprising:

a frame;

a lift arm structure having a first arm pivotally mounted to the frame and a second arm coupled to the first arm and configured to extend from and retract into the first arm;

an implement interface coupled to a distal end of the second arm of the lift arm structure and configured to mount an implement to the lift arm structure;

a first actuator coupled between the first arm and the frame and configured to raise and lower the first arm by pivoting the first arm relative to the frame;

a second actuator coupled to the second arm and the first arm and configured to extend and retract the second arm relative to the first arm to control a position of the implement interface or the implement attached to the implement interface relative to the first arm;

at least one operator input device configured to provide an operator input;

a control system including a controller configured to control the first and second actuators, responsive to the operator input, to implement a lift operation, wherein during the lift operation the first actuator raises the first arm and the second actuator extends and retracts the second arm relative to the first arm to maintain a substantially linear path of the implement interface or the implement attached to the implement interface, wherein the control system is further configured to control the second actuator to move the implement interface or the implement attached to the implement interface both vertically upward away from a support surface and horizontally toward the frame from a loading position to a carry position, above a front axle of the power machine, without movement of the first arm by the first actuator.

10. The power machine of claim 9, wherein the substantially linear path is substantially orthogonal to a support surface on which the power machine is positioned.

11. The power machine of claim 9, wherein the substantially liner path is a substantially vertical path.

12. The power machine of claim 11, wherein the substantially vertical path is a first portion of a preset path which includes a second path portion that is not parallel to the substantially vertical path.

13. The power machine of claim 9, and further comprising a first sensor configured to provide an output indicative of a position of the first arm relative to a reference and a second sensor configured to provide an output indicative of a position of the second arm relative to the first arm, and wherein the control system is configured to control the first and second actuators during the lift operation as a function of the outputs of the first and second sensors.

14. The power machine of claim 13, wherein the control system is configured to control the first and second actuators during the lift operation such that as the first actuator raises the first arm from a lowered position to an intermediate position the second actuator retracts the second arm to maintain the substantially linear path of the implement interface or the implement attached to the implement interface.

15. The power machine of claim 14, wherein the control system is configured to control the first and second actuators during the lift operation such that as the first actuator raises the first arm upward from the intermediate position the second actuator extends the second arm to maintain the substantially linear path of the implement interface or the implement attached to the implement interface.

16. A power machine comprising:

a frame;

a lift arm structure having a boom pivotally mounted to the frame and a telescoping arm coupled to the boom and configured to extend and retract relative to the boom;

an implement interface coupled to a distal end of the telescoping arm of the lift arm structure and configured to mount an implement to the lift arm structure;

a first actuator coupled between the boom and the frame and configured to raise and lower the boom;

a second actuator coupled between the telescoping arm and the boom and configured to extend and retract the telescoping arm relative to the boom;

a control system including a controller configured to control the second actuator to move the implement interface or the implement attached to the implement interface both vertically upward away from a support surface and horizontally toward the frame from a loading position to a carry position that is vertically further from the support surface than the loading position, wherein in the loading position the boom is in a lowered position and the telescoping arm is in an extended position, and wherein in the carry position the boom remains in the lowered position and the telescoping arm is in a retracted position.

17. The power machine of claim 16, and further comprising a third actuator coupled between the telescoping arm and the implement interface and configured to control rotation of the implement interface relative to the telescoping arm, wherein the controller is further configured to rotate the implement interface or the implement attached to the implement interface relative to the telescoping arm when moving the implement interface or the implement attached to the implement interface from the loading position to the carry position.

18. The power machine of claim 16, wherein when the implement interface is in the loading position a bottom of the implement interface is positioned less than 20 centimeters above the ground, and wherein when the implement interface is in the carry position, the bottom of the implement interface is positioned at least 20 centimeters above the ground.

19. The power machine of claim 16, wherein when the implement interface is in the loading position a bottom of the implement interface is positioned below a front axle of the power machine, and wherein when the implement interface is in the carry position, the bottom of the implement interface is positioned above the front axle of the power machine.

20. A power machine comprising:

a frame;

a lift arm structure having a boom pivotally mounted to the frame and a telescoping arm coupled to the boom and configured to extend from and retract into the boom;

an implement interface coupled to a distal end of the telescoping arm of the lift arm structure and configured to mount an implement to the lift arm structure;

a first actuator coupled between the boom and the frame and configured to raise and lower the boom;

a second actuator coupled between the telescoping arm and the boom and configured to extend and retract the telescoping arm relative to the boom;

at least one operator input device configured to generate an auto-carry command in an auto-carry mode of operation;

a control system coupled to the at least one operator input device and including a controller configured to control the first and second actuators during a lift operation such that the first actuator raises the boom and such that the second actuator extends and retracts the telescoping arm to maintain a substantially vertical path of the implement interface or the implement attached to the implement interface throughout the lift operation, wherein in the auto-carry mode of operation the control system is configured to control the second actuator, responsive to the auto-carry command, to automatically move the implement interface or the implement attached to the implement interface both vertically upward away from a support surface and horizontally toward the frame from a loading position to a carry position without movement of the boom by the first actuator; and a first sensor configured to provide an output indicative of a position of the boom relative to a reference and a second sensor configured to provide an output indicative of a position of the telescoping arm relative to the boom, and wherein the control system is configured to control the first and second actuators during the lift operation as a function of the outputs of the first and second sensors.

21. The power machine of claim 20, and further comprising a cab mounted on the frame, wherein the boom of the lift arm structure is pivotally mounted to the frame forward of the cab.

* * * * *